United States Patent [19]

Tighe, Jr.

[11] Patent Number: 4,719,319

[45] Date of Patent: Jan. 12, 1988

[54] SPIRAL CONFIGURATION RIBBON COAXIAL CABLE

[75] Inventor: Charles I. Tighe, Jr., Hershey, Pa.

[73] Assignee: AMP Incorporated, Harrisburg, Pa.

[21] Appl. No.: 838,641

[22] Filed: Mar. 11, 1986

[51] Int. Cl.[4] ..... H01B 11/18; H01B 7/22

[52] U.S. Cl. ..... 174/103; 174/106 R; 174/109; 174/113 C; 174/115; 174/117 F

[58] Field of Search ..... 174/103, 106 R, 109, 174/113 C, 115, 117 F

[56] References Cited

U.S. PATENT DOCUMENTS

| | | | |
|---|---|---|---|
| 2,056,017 | 9/1936 | Piercy | 174/103 |
| 2,189,091 | 2/1940 | Unterbusch | 174/106 R |
| 3,325,589 | 6/1967 | Mildner | 174/36 |
| 3,376,378 | 4/1968 | Bullock | 174/106 R |
| 3,588,317 | 6/1971 | Hutchins, Jr. | 174/106 R |
| 3,644,659 | 2/1972 | Campbell | 174/113 C X |
| 3,775,552 | 11/1973 | Schumacher | 174/36 X |
| 3,829,603 | 8/1974 | Hansen et al. | 174/36 X |
| 3,963,854 | 6/1976 | Fowler | 174/106 R X |
| 4,443,277 | 4/1984 | Rokas | 174/113 C |
| 4,477,693 | 10/1984 | Krabec et al. | 174/106 R X |
| 4,588,852 | 5/1986 | Fetterolf et al. | 174/117 F X |

FOREIGN PATENT DOCUMENTS

| | | | |
|---|---|---|---|
| 2715585 | 10/1978 | Fed. Rep. of Germany | 174/113 C |

*Primary Examiner*—Morris H. Nimmo
*Attorney, Agent, or Firm*—Gerald K. Kita

[57] ABSTRACT

A coaxial cable 1 comprises, parallel and coplanar conductors 5 each surrounded concentrically by a separate corresponding dielectric sheath 6, each said dielectric sheath 6 being concentrically encircled by a separate and conductive outer conductor 7, a dielectric jacket 4 surrounding and containing each outer conductor 7, the jacket 4 being helically wrapped along the length of an elongated cord 9, a flexible and conductive film 11 helically wrapped and surrounding the jacket 4, a conductive tubular sheath 14 surrounding the conductive film 11, and an insulative outer jacket 15 surrounding the conductive sheath 14.

8 Claims, 3 Drawing Figures

SPIRAL CONFIGURATION RIBBON COAXIAL CABLE

FIELD OF THE INVENTION

The invention resides in a ribbon coaxial cable with multiple parallel coaxial conductors in an insulative jacket of a spiral configuration with an enhanced capacity for flexure.

BACKGROUND OF THE INVENTION

A ribbon coaxial cable, known from U.S. Pat. No. 3,775,552 to Schumacher, Nov. 27, 1973, comprises spaced apart coaxial conductors that are parallel side-to-side in a common plane and in an insulative jacket. The centerlines of the conductors are spaced apart by distances that are matched to corresponding distances between centerlines of respective electrical terminals mounted in an electrical connector. The conductors are capable of alignment with corresponding terminals without a need for exposing the conductors from the cable jacket. Such alignment reduces difficulties associated with finding the conductors in the jacket and with handling each conductor individually for alignment with a corresponding terminal. Thus, ribbon coaxial cable comprises parallel coaxial conductors in a common plane thereby to reduce the difficulties associated with, first, finding of the conductors within the cable and then, aligning the conductors for connection with respective electrical terminals.

One disadvantage of ribbon coaxial cable is its lack of capacity for flexure in the common plane of the conductors. Ribbon coaxial cable is not suited for use in an environment which requires flexure of the cable in many different planes. Another type of coaxial cable that is more suitable, contains multiple coaxial conductors in a bundle, wherein the conductors are not in a common plane and are packed closely together side-to-side in the bundle to reduce interstitial spaces along the bundle. For example, U.S. Pat. No. 3,829,603 discloses a cable of this construction. This cable is flexible in more planes than is a ribbon coaxial cable, but lacks the advantages of parallel conductors in a common plane as in a ribbon coaxial cable.

SUMMARY OF THE INVENTION

The invention resides in a coaxial cable that has the flexibility of a cable wherein the conductors are in a bundle, and the further advantages of a ribbon coax cable having parallel spaced apart conductors in a common plane. The invention resides further in a coaxial cable which has parallel coaxial conductors contained within a flexible jacket of insulation which can be exposed from the cable and laid flat to position the conductors side-to-side and coplanar as in a ribbon coaxial cable. Inside the cable, the jacket is repeatedly helically coiled on itself in a continuous spiral over the length of a tension resisting cord. A conductive tubular sheath is a composite of metal plated plastic film concentrically surrounded by braided wire strands. The sheath surrounds the jacket and the conductors in the jacket. The sheath retains the jacket helically coiled on itself and helically in place around and along the cord. Thereby the sheath prevents the jacket from uncoiling and assuming a flat configuration. When a length of the sheath is removed, a length of the jacket is exposed and is freed of the sheath to assume substantially a planar configuration, thereby to position the coaxial conductors side-to-side and coplanar as in a ribbon coaxial cable.

An object of the invention is to provide a coaxial cable of round outer configuration and containing a plurality of coaxial conductors joined side-to-side in a jacket that is capable of assuming a flat configuration to position the coaxial conductors coplanar as in a ribbon coaxial cable.

Another object is to provide a coaxial cable in which a plurality of coaxial conductors are side-to-side within a flat jacket of insulative material, and the jacket is repeatedly helically coiled on itself in a continuous spiral along the length of a tension resisting cord.

Another object is to provide a coaxial cable in which coils of a flat flexible ribbon coaxial form a continuous spiral over and along the length of a tension resisting cord, and the coils are surrounded by a conductive tubular sheath.

Other objects and advantages of the invention are available from an understanding of the following detailed description taken in conjunction with the drawings, wherein, FIG. 1 is an enlarged fragmentary perspective view of a cable.

Figure 1:
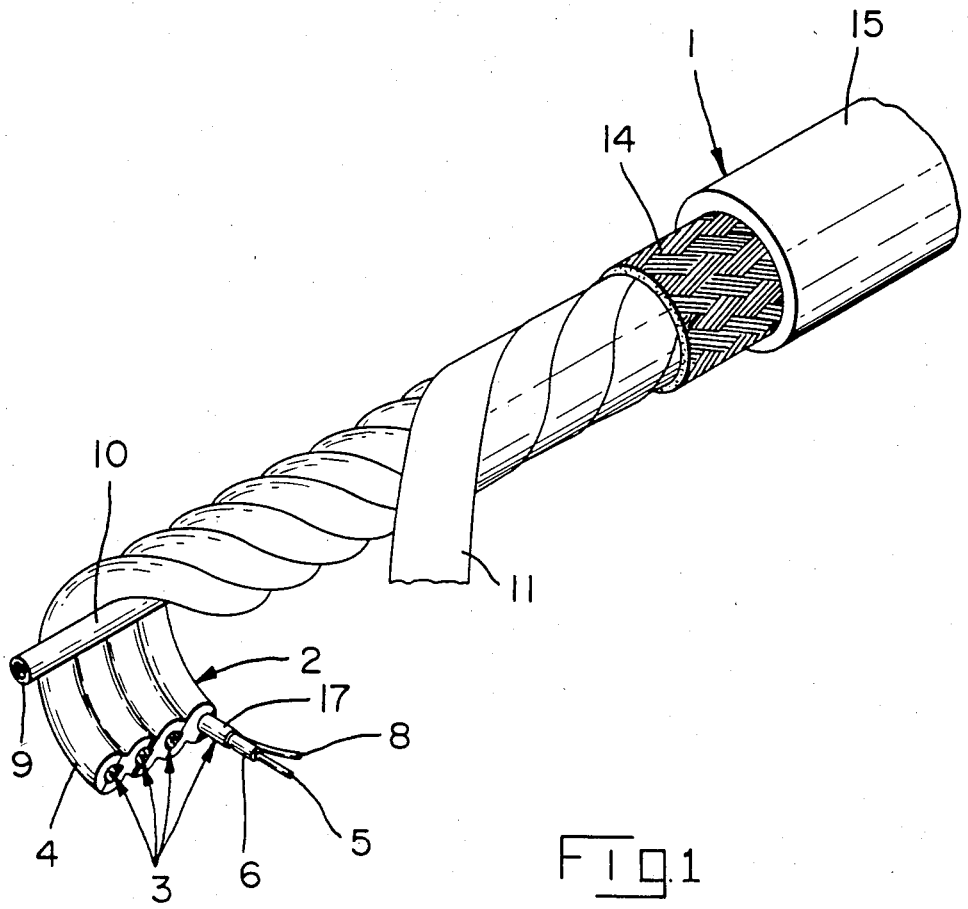
Figure 2:
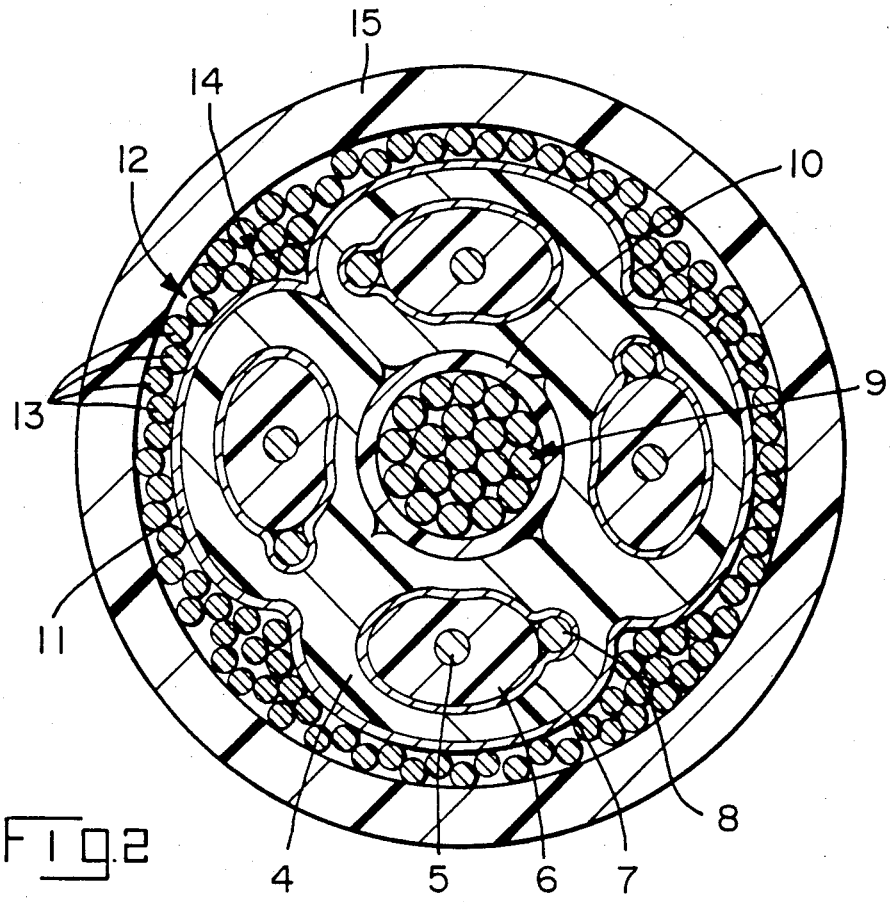
FIG. 2 is an enlarged cross section of the cable shown in FIG. 1.
Figure 3:
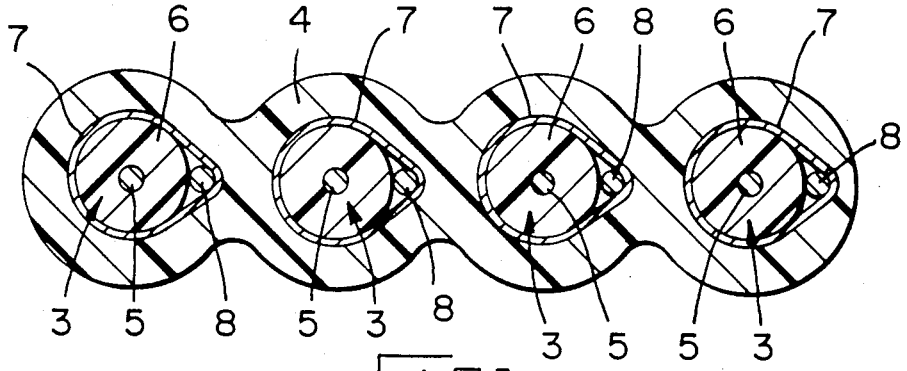
FIG. 3 is an enlarged cross section showing a flat configuration assumed by a coaxial cable portion of the cable shown on FIG. 1.

By way of example, the invention will be described by use of the drawings in conjunction with the following description of an embodiment of the invention. An electrical cable 1 is shown in FIG. 1. A ribbon coaxial cable portion 2 of the cable 1 comprises a plurality of spaced apart coaxial conductors 3 aligned parallel to one another and surrounded by an insulative flexible jacket 4. Each coaxial conductor 3 includes, a center conductor 5 surrounded concentrically by a separate corresponding insulative flexible dielectric sheath 6, conductive parallel and coplanar drain wires 8 continuously engaging respective dielectric sheaths, a separate corresponding conductive outer conductor 7 encircling each dielectric sheath 6 and a corresponding drain wire 8, and the insulative jacket 4 surrounding and containing each outer conductor 7.

Each center conductor 5 is tin plated copper having a diameter of Number 30 American Wire Gauge.

Each dielectric sheath 6 is polytetrafluroethylene having a diameter of 0.064 inches.

Each drain wire is an elongated tin plated copper wire having a diameter of Number 30 American Wire Gauge. Each drain wire 8 continuously engages a corresponding dielectric sheath 6 and a corresponding outer conductor 7 that contains a corresponding drain wire 8 and a corresponding dielectric sheath 6.

Each outer conductor 7 is a sheath, for example, of conductive foil 0.00135 inch thickness.

The outer insulative jacket 4 is polyethylene having a thickness of 0.100 inches.

The ribbon coaxial cable portion 2 surrounds a central cord 9, for example, comprised of nineteen strands each of 0.014 inches diameter stainless steel, the strands having been gathered together in a bundle to form the single cord having a gauge measurement of number 14 American Wire Gauge. A jacket 10 of polyvinylchloride surrounds the strands.

The ribbon coaxial cable portion 2 engages and surrounds the cord 9 with continuous spiral windings that turn in a direction clockwise, for example, around the cord 9 and along the length of the cord 9. There are eleven windings along each foot length of the cord 9. The windings abut one another without overlap.

The ribbon coaxial cable portion 2 is engaged and covered by a thin flexible conductive film 11, for example, a layer of aluminum foil 0.00035 inch in thickness bonded by a layer of adhesive 0.00015 inch in thickness to an insulative film of polyester 0.00050 inch in thickness. For example, the insulative film may comprise a film of polyester material identified by the trademark MYLAR of E. I. Dupont Nemours, Wilmington, Del. The conductive film 11, for example, is in the form of a ribbon 0.500 wide surrounding the ribbon coaxial cable portion 2 with continuous spiral windings that turn in a direction opposite to the direction of turns in the ribbon coaxial portion. The windings overlap one another 0.125 inch.

The conductive film 11 is engaged and surrounded concentrically by a tubular envelope 12 of braided wires 13 electrically engaging the foil. The wires 13 are Number 34 American Wire Gauge tin plated copper wires, eight wires each in twenty-four cords, braided into eleven pickes per inch. Together the conductive film 11 and the envelope 12 comprise a conductive sheath 14 covering the spirally laid coaxial cable portion 2, preventing the coaxial cable portion 2 from uncoiling and assuming a flat configuration. The braided wires 13 also provide tensile strength and resistance to penetration into the coaxial cable portion. The braided wires 13 further provide a conductive shield against relatively low range, radio frequency interference, with 85 percent overlapped coverage of the coaxial cable portion. The conductive foil of the film 11 underlying concentrically the braided wires 13 provides a conductive shield for relatively high range, radio frequency interference, with continuous overlying coverage of the coaxial cable portion 2.

The conductive sheath 14 is concentrically engaged and surrounded by an outer jacket 15 of black polyvinyl chloride 0.035 inches thick. The outer diameter of the jacket 15 of the cable 1 is 0.380 inches maximum.

The cable 1 is readily flexible in all directions transverse to its longitudinal axis. For example, the cable 1 passes a known test for flexibility, which involves bending one portion of the cable 1 in a loop of two inches diameter, first in one direction, and then reversely bending the cable 1 in a loop in the opposite direction. Bending and reversely bending is repeated for one thousand cycles.

As shown in FIG. 1, when it is desired to terminate the coaxial cable portion 2 with corresponding electrical contacts, not shown, a portion of the coaxial cable portion 2 is caused to protrude from the remainder of the cable 1, for example, by cutting away corresponding portions of the conductive film 11, the braided wires 13 and the outer jacket 15. The protruding portion of the coaxial cable portion 2 is then uncoiled and laid flat, thereby to orient the coaxial conductors 3 coplanar, parallel, and spaced apart by known distances. The coplanar and parallel coaxial conductors 3 provide the advantages of ribbon coaxial cable as disclosed in conjunction with the aforementioned U.S. Pat. No. 3,775,552.

I claim:

1. A flexible electrical cable comprising, an elongated cord extending the length of the cable, an insulative jacket extending the length of the cable, spaced apart electrical conductors aligned parallel with one another within the jacket and surrounded respectively by the jacket, a conductive sheath surrounding the jacket, the improvement comprising, the jacket and the conductors within the jacket being helically coiled around the cord and along the length of the cord and constructed for uncoiling from around the cord and assuming a flat planar configuration to position the conductors within the jacket coplanar with one another, said conductive sheath engaging the helically coiled jacket and preventing the helically coiled jacket from uncoiling, and said conductive sheath including a helically wrapped conductive film surrounding the helically coiled jacket and providing continuous overlying coverage thereof and a tubular envelope of wires surrounding and electrically engaging the conductive film.

2. A flexible electrical cable as recited in claim 1, the improvement further comprising, said conductive sheath includes an insulative film bonded to the conductive film.

3. A flexible electrical cable as recited in claim 1, wherein each of the conductors is a coaxial conductor and comprises, a center conductor, an insulative sheath encircling the center conductor, and a conductive outer conductor encircling the insulative sheath.

4. A flexible electrical cable as recited in claim 2, wherein each of the conductors is a coaxial conductor and comprises, a center conductor, an insulative sheath encircling the center conductor, and a conductive outer conductor encircling the insulative sheath.

5. A flexible electrical cable as recited in claim 1, wherein the conductive film is a ribbon helically wrapped over the jacket and along the length of the jacket.

6. A flexible electrical cable as recited in claim 2, wherein the conductive film is a ribbon helically wrapped over the jacket and along the length of the jacket.

7. A flexible electrical cable as recited in claim 2, wherein the conductive film and insulative film comprise a ribbon helically wrapped over the jacket and along the length of the jacket.

8. A coaxial cable comprising, an elongated cord, parallel and coplanar conductors each surrounded concentrically by a separate corresponding dielectric sheath, each said dielectric sheath being concentrically encircled by a separate and conductive outer conductor, a dielectric jacket surrounding and containing each outer conductor, the dielectric jacket being helically coiled around and along the length of the elongated cord, a flexible and conductive ribbon helically wrapped and surrounding the dielectric jacket and providing continuous overlying coverage thereof, a conductive tubular sheath surrounding the conductive ribbon, said ribbon and said sheath surrounding the dielectric jacket and preventing uncoiling of the dielectric jacket, and an insulative outer jacket surrounding the sheath, the outer jacket and the ribbon and the sheath being removable and the ribbon and the sheath being removable from said dielectric jacket to permit uncoiling of said dielectric jacket, and said dielectric jacket being constructed for uncoiling from around the elongated cord to a flat planar configuration to position said conductors in corresponding coplanar positions.

* * * * *